US007685859B2

(12) United States Patent
Ukpai et al.

(10) Patent No.: US 7,685,859 B2
(45) Date of Patent: Mar. 30, 2010

(54) CRIMPING APPARATUS AND METHOD

(75) Inventors: Ukpai I. Ukpai, West Bloomfield, MI (US); Andrew L. Bartos, Clarkston, MI (US)

(73) Assignee: GM Global Technology Operations, Inc., Detroit, MI (US)

( * ) Notice: Subject to any disclaimer, the term of this patent is extended or adjusted under 35 U.S.C. 154(b) by 237 days.

(21) Appl. No.: 11/671,476

(22) Filed: Feb. 6, 2007

(65) Prior Publication Data

US 2008/0184767 A1 Aug. 7, 2008

(51) Int. Cl.
*B21D 17/02* (2006.01)
*B21D 37/14* (2006.01)

(52) U.S. Cl. ..... 72/414; 72/475

(58) Field of Classification Search ..... 72/412–417, 72/475

See application file for complete search history.

(56) References Cited

U.S. PATENT DOCUMENTS 3,365,927 A * 1/1968 Lynch ..... 72/416
4,450,706 A * 5/1984 Engelmohr ..... 72/385
5,802,908 A * 9/1998 Frenken ..... 72/409.16

OTHER PUBLICATIONS

Using Nitinol Alloys, Johnson Matthey Engineering Reference, 2003, San Jose, CA.

* cited by examiner

*Primary Examiner*—Dana Ross
*Assistant Examiner*—Teresa M Bonk
(74) *Attorney, Agent, or Firm*—Quinn Law Group, PLLC

(57) ABSTRACT

A crimping apparatus and method are provided that enable secure crimping of objects to one another even when the objects are subject to thermal or stress cycling. Specifically, an apparatus for crimping a work-piece includes a die pair with a first die that defines a first groove characterized by a first cross-sectional shape as well as a second die opposing the first die. The second die defines a second groove characterized by a second cross-sectional shape different than the first cross-sectional shape. When the dies are moved together for crimping the work-piece, the first and second grooves are aligned to define a die cavity with a compound cross-sectional shape for crimping the work-piece.

8 Claims, 4 Drawing Sheets

CRIMPING APPARATUS AND METHOD

TECHNICAL FIELD

The invention relates to a pair of die for crimping two components to one another and a method for the same.

BACKGROUND OF THE INVENTION

Crimping two pieces of metal or other materials to one another, by deforming one or both of them to hold the other, is used extensively in metalworking. Crimping is also used to connect an electrical connector to a conductive component such as an electrical wire. Crimping is a cold-working technique that can form a strong bond between the two crimped objects.

Certain materials, such as brittle materials or other materials with difficult cold-working properties, may be difficult to crimp to other materials. Additionally, when one of the objects is subjected to thermal or stress cycling, the bond created by crimping may weaken or fail. For example, if an electrical connector is crimped to an active material such as a shape memory material wire using a standard crimp with a uniform cross-sectional area (such as a circular crimp or a barrel crimp), the cyclical shape change of the active material occurring with thermal cycling may diminish the bond.

SUMMARY OF THE INVENTION

A crimping apparatus and method are provided that enable secure crimping of objects to one another even when the objects are subject to thermal cycling.

Specifically, an apparatus for crimping a work-piece includes a die pair with a first die that defines a first groove characterized by a first cross-sectional shape as well as a second die opposing the first die. The second die defines a second groove characterized by a second cross-sectional shape different from the first cross-sectional shape. For example, the first cross-sectional shape may be rectangular while the second may be triangular. When the dies are moved together for crimping the work-piece, the first and second grooves are aligned to define a die cavity with a compound cross-sectional shape for crimping the work-piece.

Preferably, each of the first and second dies has first and second portions connected to one another. Each portion defines a respective segment of the groove in the die. The groove is therefore multi-segmented, and has different cross-sectional shapes in the different segments. Specifically, the first groove may have the first cross-sectional shape in the first portion and be further characterized by the second cross-sectional shape in the second portion. The second groove may be characterized by the second cross-sectional shape in the first portion and by the first cross-sectional shape in the second portion. Thus, in such an embodiment, like cross-sectional shapes are positioned diagonally from one another when the first and second portions are connected together. Accordingly, the die cavity formed by the grooves when the dies move together has a compound cross-sectional shape in the first portion and a compound cross-sectional shape in the second portion that is rotated with respect to the shape of the first portion. A multi-segmented, compound cross-sectional shape can therefore be imparted to the work-piece crimped by the die pair. Alternatively, different cross-sectional shapes may be positioned diagonally from one another.

Another preferable feature of the crimping apparatus is that the respective grooves of the first and second dies are formed or otherwise machined such that the respective segments are partially offset from one another. That is, the centerline of the first groove in the first portion of the first die is offset from a centerline of the first groove in the second portion of the first die. Likewise, the centerline of the second groove in the second die is offset in the first and second portions of the second die. When crimping an electrical connector around an elongated conducting component, such as a shape memory material wire, the compound cross-sectional shape of the die cavity will be imparted to the crimped material (i.e., the electrical connector and the elongated conducting component) so that the crimped material will have a compound cross-sectional shape with partially offset segments, and will also be deformed with the offset segments. As used herein, "partially offset" means that the respective centerlines of the respective segments are not collinear, but the segments form a continuous cavity. The offset could be vertical or lateral.

The crimping apparatus preferably has an alignment feature that aligns the first and second dies as they are brought together so that the first and second grooves are directly opposite one another to form the die cavity with the multi-segmented compound cross-sectional shape. The alignment feature may be a notch in the first portion of one of the dies that is received in a recess in the first portion of the other die. The die that has the notch in one portion may have a recess in the other portion that aligns with a notch in the opposing portion of the other die.

Preferably, the die pair offers numerous aligned grooves forming alternate die cavities each with a compound cross-sectional shape and with the grooves having different depths such that the alternate die cavities have reduced compound cross-sectional shapes that may be selected for crimping smaller size objects.

The crimping apparatus preferably includes a fixture that secures the work-piece during crimping. Specifically, the fixture has recesses spaced a predetermined distance from one another. Each recess is sufficiently sized to receive the aligned die pair. Additionally, the fixture is configured to support the work-piece when the work-piece spans across the spaced recesses. Thus, the dies are able to crimp the work-piece at two locations spaced apart by the predetermined distance.

Optionally, the fixture may include an adjustment mechanism that permits the predetermined distance to be varied so that work-pieces of different lengths may be crimped.

A method of crimping two components of a work-piece to one another is further provided. The components may be a first component that is an elongated wire and a second component that is an electrical connector. The method includes coating a surface of the first component with an adhesive. The first component is then inserted into the second component and the second component is then crimped to the inserted first component with the tool that has the die cavity characterized by a compound cross-sectional shape. As used herein, "compound cross-sectional shape" means a shape that has first and second portions that are asymmetrical.

The method preferably further includes securing the work-piece to a fixture that has spaced supports for supporting a different second component near each end of the first component with predetermined spacing therebetween. The effective length of the first component is thereby regulated as the crimped second components at either end thereof are located according to the predetermined spacing. As used herein, "effective length" means the length of the first component (e.g., the elongated conducting component) between the two second components crimped thereto.

Preferably, the dies used in the method are configured to define multiple different sized compound cross-sectional die cavities. The method may then include selecting one of the cavities based on the size of the second component prior to crimping.

The above features and advantages and other features and advantages of the present invention are readily apparent from the following detailed description of the best modes for carrying out the invention when taken in connection with the accompanying drawings.

DESCRIPTION OF THE PREFERRED EMBODIMENTS

Figure 1:
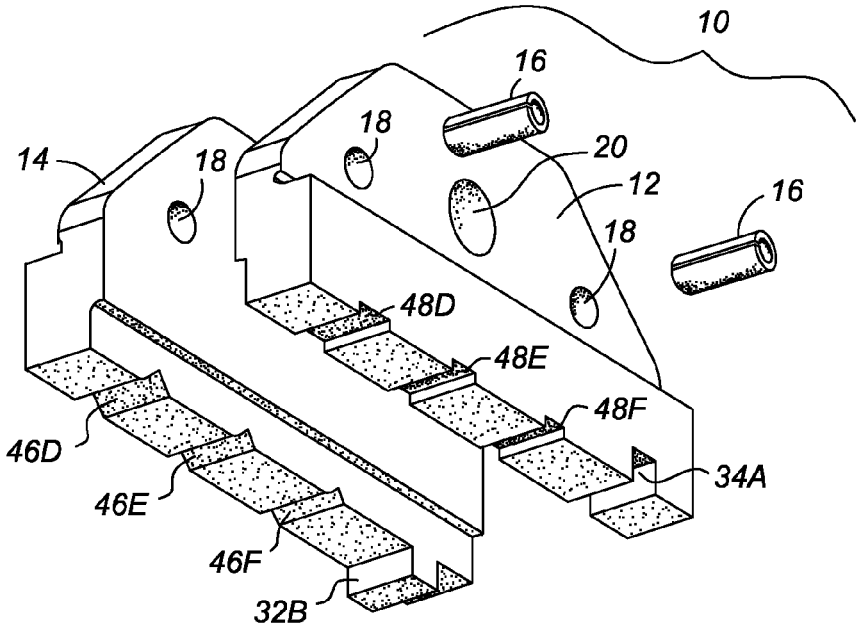
FIG. 1 is a schematic perspective illustration in exploded view of a die.
Figure 2:
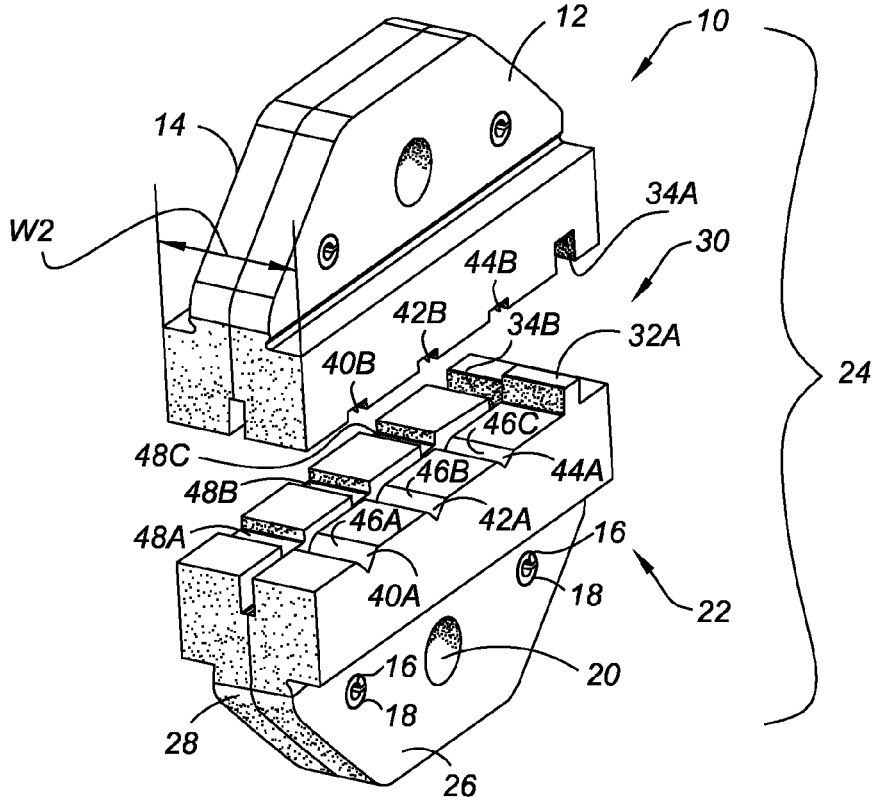
FIG. 2 is a schematic perspective illustration of the a die pair including the die of FIG. 1 and a mating, lower die.

Referring to the drawings wherein like reference numbers refer to like components, in FIG. 1, a first die 10, which may also be referred to as an upper die, is shown in an exploded form with a first portion or die half 12 and a second portion or die half 14 configured to be connected side by side with one another as shown in FIG. 2 by inserting pin 16 through aligned pin holes 18 (only one pin hole is visible on die portion 14). An opening 20 in die portion 12 aligns with a like opening (not visible in die portion 14 in FIG. 1) for receiving a tool handle (not shown) therethrough, as will be understood by those skilled in the art), to form a pair of crimping pliers.

Referring to FIG. 2, the first die 10 is aligned with a second die 22 to form a die pair 10, 22. The second die 22, also referred to as a lower die, includes a first portion 26 and a second portion 28. As will be discussed hereinafter, it is apparent from FIGS. 1 and 2, that the lower die 22 is essentially identical to the upper die 10 and is a duplicate component thereof. Each aligned pair of portions of the dies 10, 22 includes an alignment feature 30 consisting of a notch in one portion (i.e., notches 32A and 32B) matable with a recess in the opposed portion (i.e., recesses 34A and 34B). The lower die 22 also includes an opening 20 for the tool handle as well as opening 18 to receive connecting pin 16 therethrough to form a crimping apparatus 24.

The lower die 22 is formed with a series of spaced, multi-segmented grooves 40A, 42A and 44A. Each groove includes multiple segments. For example, groove 40A includes a first segment 46A in the first portion 26 and a second segment 48A in the second portion 28. Segment 46A has a triangular cross-sectional shape while segment 48A has a rectangular cross-sectional shape. Grooves 42A and 44A each also have multiple segments, including first segments 46B and 46C and second segments 48B and 48C, respectively. Groove segments 46B and 46C have triangular cross-sectional shapes, and groove segments 48B and 48C have rectangular cross-sectional shapes.

The upper die 10 also has a series of spaced multi-segmented grooves 40B, 42B and 44B. As better viewed in FIG. 1, groove 40B has two segments 48D and 46D, groove 42B has two segments 48E and 46E and groove 44B has two segments 48F and 46F. The first segments 48D, 48E and 48F on portion 12 have a rectangular cross-sectional shape while the second portions 46D, 46E and 46F on portion 14 have a triangular cross-sectional shape.

As is apparent in FIG. 2, the rectangular cross-sectional shape groove segments 40B, 42B and 44B of portion 12 are aligned with the triangular cross-sectional shape groove segments 40A, 42A and 44A of portion 26 while the triangular cross-sectional shape groove segment 46D, 46E and 46F of portion 14 align with the rectangular cross-sectional shape groove segments 48A, 48B and 48C of portion 28 (see also FIG. 1). Thus, when the dies 10 and 22 are brought together for crimping, the groove segments with the rectangular cross-sectional shape are located diagonally from one another while the groove segments with the triangular cross-sectional shape are located diagonally from one another in the multi-segmented grooves formed. It should be appreciated that the dies may have groove segments that each have a different cross-sectional shape, in which case groove segments located diagonally from one another would not be similar.

Figure 3:
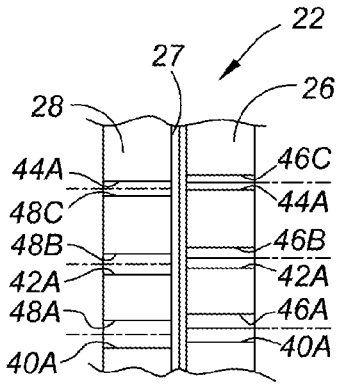
FIG. 3 is a schematic fragmentary top view of the lower die of FIG. 2.

Referring to FIG. 3, a fragmented top view of die portion 22 with portions 26 and 28 connected is illustrated. The triangular cross-sectional shaped groove segments 46A, 46B and 46C are offset from their corresponding rectangular cross-sectional shaped groove segments 48A, 48B and 48C, respectively. That is, a centerline of the groove segment 46A is laterally offset from a centerline of groove segment 48A, a centerline of groove segment 46B is laterally offset from a centerline of groove segment 48B and a centerline of groove segment 46C is laterally offset from a centerline of groove segment 48C. Thus, the respective segments of each multi-segmented groove 40A, 42A and 44A are slightly offset from one another. A small gap 27 runs between the respective segments 46A, 48A; 46B, 48B; and 46C, 48C. The offset nature of the groove segments helps to strengthen a bond between crimped components, as will be explained further below.

Figure 4:
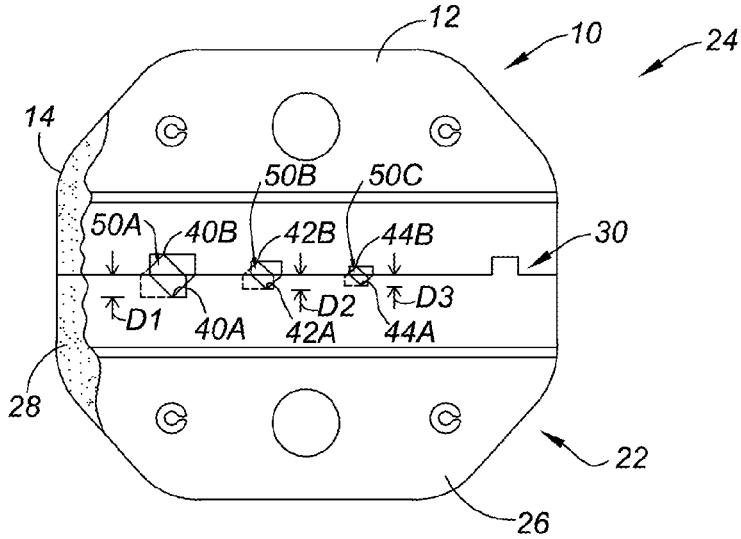
FIG. 4 is a partially fragmentary, schematic side view of the die pair of FIG. 2 in a closed, crimping position.

Referring to FIG. 4, when the die 10 is aligned with the die 22 via the alignment feature 30, the respective grooves 40A, 42A, and 44A of the portion 26 and respective grooves 40B, 42B, and 44B of portion 12 are aligned to form die cavities 50A, 50B, and 50C, respectively, each having a multi-segmented, compound cross-sectional shape. FIG. 4 illustrates the effect of the offset nature of the groove segments on the resulting compound multi-segmented die cavities 50A, 50B and 50C. Additionally, it is apparent from FIG. 4 that the compound cross-sectional shape of the segments of the die cavities 50A, 50B and 50C formed by the first portions 12 and 26 are rotated with respect to the compound cross-sectional shape of the die cavities 50A, 50B and 50C formed by the die portions 14 and 28, as is visible from the outline of the perimeter of the die cavity in those segments. Specifically, the cross-sectional shape of the die cavities formed by the segments of the grooves 40A, 42A and 44A (formed by portions 12 and 26) are rotated 180 degrees with respect to the die cavities formed with the segments of the grooves 40A, 42A, 44A (formed by the portions 14 and 28). It should be appreciated that such diagonal symmetry is not required and that, in other embodiments, groove segments positioned diagonally from one another may have different cross-sectional shapes.

The grooves 40A, 42A and 44A are different respective depths as are the grooves 40B, 42B and 44B. As is best illustrated in FIG. 4, groove 40A has a depth D1 while groove 42A has a lesser depth D2 and groove 44A has an even lesser depth D3. The respective depths of the grooves 40B, 42B and 44B in the die 10 are successively decreasing as well. Thus, the die cavity 50C will have a reduced compound cross-sectional shape as compared to die cavity 50B, which in turn will have a reduced compound cross-sectional shape as compared to die cavity 50A. As used herein, a "reduced compound cross-sectional shape" refers to the area of the cross-section of the groove. The differently-sized compound cross-sectional shapes offered by the series of die cavities 50A, 50B and 50C allows a variety of differently-sized work-pieces to be crimped using the same crimping apparatus 24.

Figure 5:
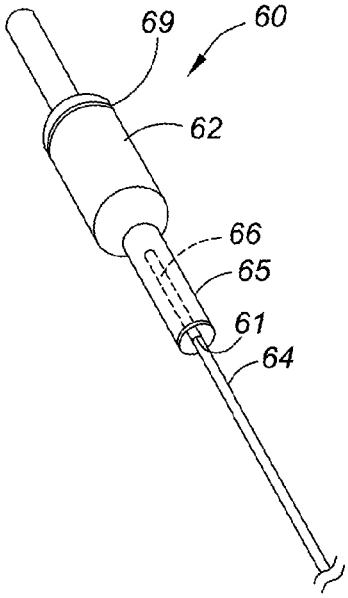
FIG. 5 is a schematic, perspective fragmentary view of a work-piece including an electrical connector and an elongated conductor component prior to crimping of the electrical connector.

Referring to FIG. 5, a work-piece 60 includes an electrical connector 62 (also referred to as an electrical terminal) that may be crimped to an elongated conducting component 64 using the crimping apparatus 24. Work-piece 60 is shown prior to crimping. As is understood by those skilled in the art, an electrical connector such as electrical connector 62 completes the circuit between an incoming electrical component (not shown) and another electrical component such as elongated conducting component 64. Preferably, elongated conducting component 64 is a shape memory alloy such as NITINOL. NITINOL (an acronym for NIckel TItanium Naval Ordnance Laboratory) is a family of intermetallic materials that contain a substantially equal mixture of nickel and titanium. Other elements may be added to vary the material properties. The work-piece 60 is prepared for crimping by coating a surface 66 of the conducting component 64 with an adhesive and inserting a portion of the elongated component 64 with the coated surface into an opening 61 in a neck portion 65 of the electrical connector 62. An opposite end (not shown) of the elongated conducting component 64 is prepared in the same way and is inserted into a separate electrical connector, which may be identical to the electrical connector 62. The electrical connector 62 has a groove 69 therearound. A flexible retaining ring (visible in FIG. 7) may be placed in the groove for locating the electrical connectors 62 by abutting the supports 76A and 76B.

Figure 7:
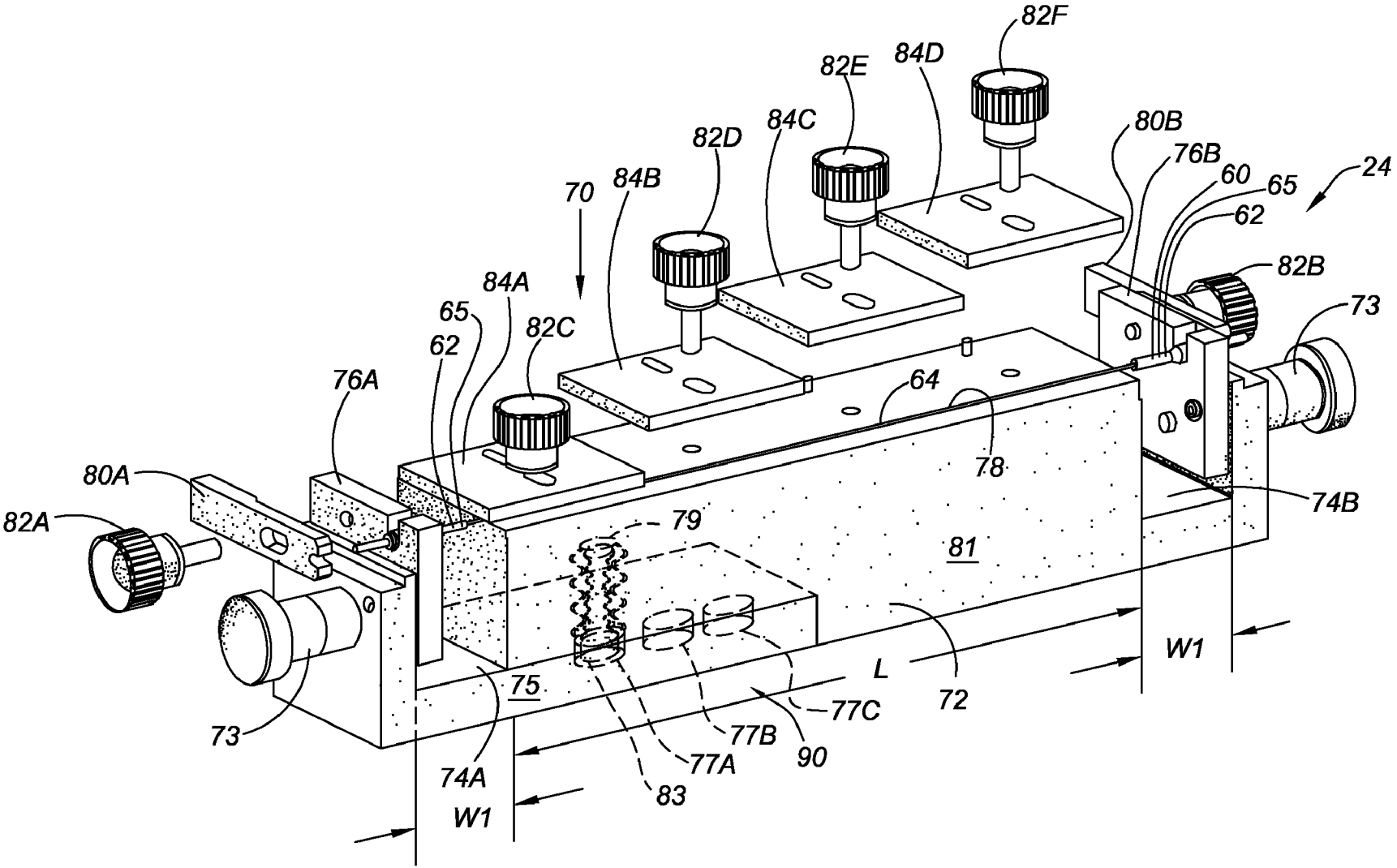
FIG. 7 is a schematic perspective illustration of a fixture used to support the work-piece of FIGS. 5 and 6.

Referring to FIG. 7, the apparatus 24 may further include a fixture 70 on which the work-piece 60 may be supported and secured prior to crimping. The fixture 70 includes a base 72 having spaced recesses 74A and 74B. Supports 76A and 76B are secured to the base 72 at the respective recesses 74A and 74B. Extensions 73 are used for securing supports 76A and 76B to the base 72. After the work-piece 60 is prepared as described with respect to FIG. 5, the connector portion 62 at either end thereof is supported at the respective supports 76A and 76B. A groove 78 formed in an upper face of the base 72 is designed to receive the elongated conducting component 64. End supports 80A and 80B are secured at the respective connector portions 62 with thumbscrews 82A and 82B. A series of cover plates 84A, 84B, 84C and 84D are secured with additional thumbscrews 82C, 82D, 82E and 82F to hold down the elongated conducting component 64 and stabilize the work-piece 60 with respect to the base 72. When the work-piece 60 is secured to the fixture 70 in this manner, the work-piece 60 spans the recesses 74A and 74B. The neck portion 65 of each electrical connector is thus stabilized over the respective recess.

The recesses 74A and 74B are located at a predetermined distance L from one another. Preferably, the predetermined spacing and distance L is variable by providing an adjustment mechanism 90 within the fixture 70. The adjustment mechanism 90 includes a translatable portion 75 of the base 72 formed with a series of fastener openings 77A, 77B and 77C that may be aligned with respect to a threaded opening 79 in a fixed portion 81 of the base 72 to receive a threaded fastener 83. By aligning different ones of the fastener openings 77A, 77B and 77C with the threaded opening 79, the translatable portion 75 moves with respect to the fixed portion 81 of the base 72. This permits different alternate work-pieces with different overall lengths to be supported on the fixture 70. Notably, the recesses 74A and 74B have a width W1 that is greater than an overall width W2 of the die pair 10, 22 (see FIG. 2). Thus, recesses 74A and 74 are sized to receive the die pair 10, 22 for crimping the neck 65 of each respective electrical connector 62 on the work-piece 60. The width of recess 74A is at a minimum W1 but may be enlarged by translating the translatable portion 75 as described above. Those skilled in the art will recognize that many other types of adjustment mechanisms may be used to vary the predetermined spacing and distance L; the adjustment mechanism 90 is just one example of such a mechanism. For example, a screw-type positioning system may be used to vary the position of the translatable portion 75 with respect to the fixed portion 81 of the base 72 by tightening or loosening a screw that connects the translatable portion 75 with the fixed portion 81 and controls the relative positions thereof.

Once the work-piece 60 is prepared as described with respect to FIG. 5 and secured to the fixture 70 as described above, an appropriately sized die cavity 50A, 50B, 50C (see FIG. 4) may be selected for crimping based on the size of the electrical connector 62. The die pair 10, 22 (connected to a tool handle (not shown)) is positioned around the neck portion 65 of the electrical connector 62 and then are moved together to crimp the neck 65 with the selected compound cross-sectional area multi-segmented die cavity.

Figure 6:
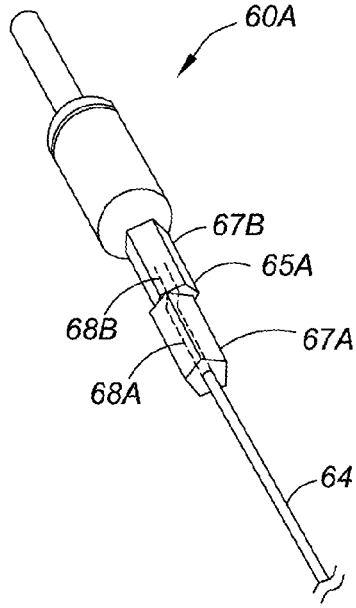
FIG. 6 is a schematic, perspective fragmentary view of the work-piece including an electrical connector and an elongated conductor component of FIG. 5 after being crimped by the die pair of FIG. 2.

Referring to FIG. 6, after crimping, the work-piece (referred to as 60A in FIG. 6) is removed from the fixture 70 with the resulting crimped neck portion, referred to as 65A in FIG. 6, deformed in the shape of the multi-segmented, compound cross-sectional area die cavity selected (either 50A, 50B or 50C). Specifically, the neck portion 65A will have a compound cross-sectional shape corresponding with the first segment of the die cavity in a first segment 67A and a compound cross-sectional shape corresponding with the second segment of the die cavity in a second segment 67B of the neck portion 65A. Crimping will also cause the inserted elongated conducting component 64 to deform with an offset pair of segments 68A and 68B, due to the offset nature of the segments of the grooves described with respect to FIG. 3. The electrical connector 62 will deform in an offset manner as well. A multi-segmented, compound cross-sectional crimp applied to connector portion 62 bonds the electrical connector 62 to the elongated conducting component 64 more securely than if a crimping tool with a uniform cross-sectional area were applied. The offset nature of the resulting crimp as well as the multi-segmented compound cross-sectional area prevents the elongated conducting component 64 from slipping out of the electrical connector 62, as it would be more likely to do, especially when subjected to thermal cycling, often under changing stress, if an electrical connector having a uniform cross-sectional area were used. Even if the electrical connector 62 and/or the elongated conducting component 64 shrink or swell in size repeatedly with thermal cycling, the asymmetrical and offset deformation imparted to these crimped components prevents detachment and also diminishes wear on the adhesive bond placed therebetween.

Figure 10:
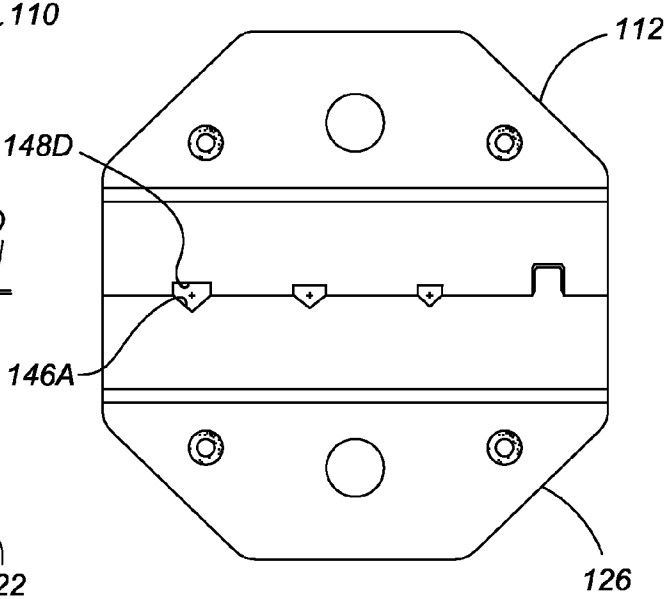
FIG. 10 is a side view of other portions of the first and second die of FIG. 8.
Figure 8:
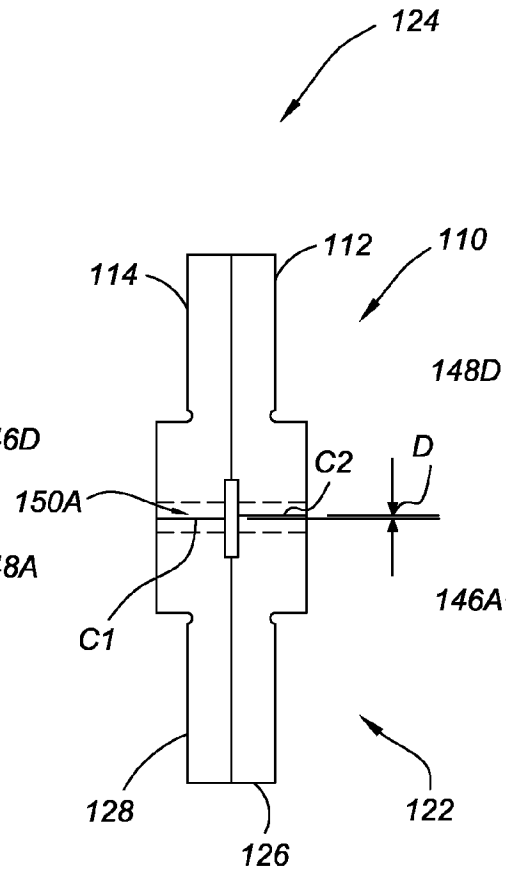
FIG. 8 is an end view of another first and second die forming a die pair with a multi-segmented, compound cross-sectional die cavity with vertically offset segments.
Figure 9:
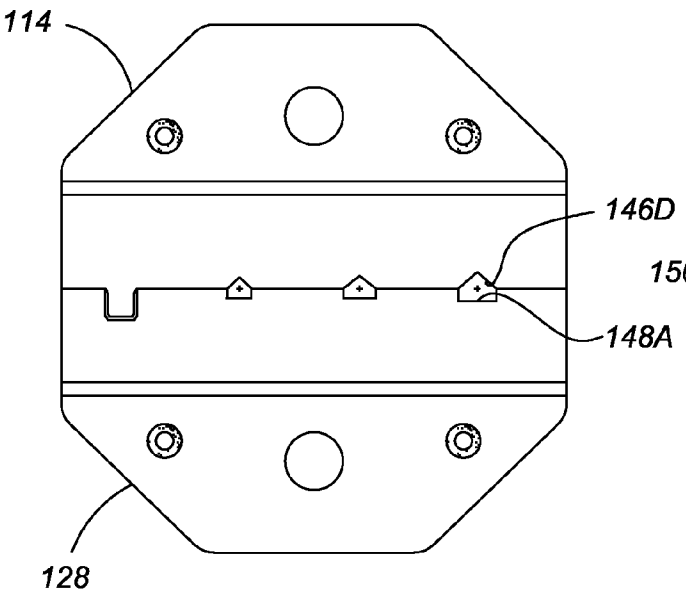
FIG. 9 is a side view of portions of the first and the second die of FIG. 8.

Referring to FIGS. 8-10, another embodiment of a crimping apparatus 124 is depicted. The crimping apparatus 124 has many of the same features as the crimping apparatus 24 of FIGS. 1-4, as is apparent in FIGS. 8-10. The crimping apparatus 124 has a first die 110 and a second die 122. The first die 110 includes first portion 112 connected to second portion 114, while the second die 122 includes a respective first portion 126 connected to a respective second portion 128.

The first portions 112 and 126 align to form a series of die cavity segments with a compound cross-sectional shape, each with a different cross-sectional area. Grooves with a rectangular cross-section, such as groove 148D, are formed in portion 112 while grooves of triangular cross-section, such as groove 146A, are formed in portion 126. A centerline C2 of the resulting die cavity segment is shown in FIG. 8 (as represented by the interface of the two portions 112, 126, which is at the same height as respective centerlines through each die cavity segment formed by the portions 112, 126).

The second portions 114 and 128 also align to form a series of die cavity segments with a compound cross-sectional shape, each with a different cross-sectional area. Grooves with a rectangular cross-section, such as groove 148A, are formed in portion 128 while grooves of triangular cross-section, such as groove 146D, are formed in portion 114. A centerline C1 of the resulting die cavity segment is shown in FIG. 8 (as represented by the interface of the two portions 114, 128, which is at the same height as respective centerlines through each die cavity segment formed by the portions 114, 128). As illustrated in FIG. 8, the centerlines C1 and C2 are offset from one another in the direction of the depth of the grooves 146A, 148D, 148A, 146D, by a distance D. The offset nature of the centerlines C1 and C2 may be referred to as "vertically offset". Thus, each die cavity formed by the die pair 110, 122, including cavity 150A, is a multi-segmented die cavity of compound cross-sectional shape, with die cavity segments that are vertically offset from one another. The crimped shape imparted to objects crimped together using the crimping apparatus 124 will strengthen the bond between the objects, even if subjected to thermal or stress cycling, especially because the crimping force applied to the die pair 110, 122 (i.e., an inward-directed force) is in the same direction or plane as the vertical offset D.

While the best modes for carrying out the invention have been described in detail, those familiar with the art to which this invention relates will recognize various alternative designs and embodiments for practicing the invention within the scope of the appended claims.

The invention claimed is:

1. An apparatus for crimping a work-piece comprising:

a first die defining a first groove characterized by a first cross-sectional shape;

a second die opposing the first die and defining a second groove characterized by a second cross-sectional shape different than the first cross-sectional shape;

whereby the first and second grooves together define a die cavity with a compound cross-sectional shape for crimping the work-piece when the dies are moved together;

wherein the first and second dies each have a first portion and a second portion, each portion defining a respective segment of the respective groove; and wherein the respective segments of each respective groove are partially offset from one another.

2. The apparatus of claim 1, further comprising:

an alignment feature aligning the first and second dies so that the first and second grooves are directly opposite one another to form the die cavity with the compound cross-sectional shape when the dies are brought together.

3. The apparatus of claim 1, wherein the first groove has a first depth; and wherein the first die further defines at least one additional groove having the first cross-sectional shape at another depth less than the first depth; and wherein the second groove has a second depth and wherein the second die further defines at least one additional groove having the second cross-sectional shape at a different depth less than the second depth;

the additional grooves of the first and second dies thereby forming an alternate die cavity with a reduced compound cross-sectional shape for crimping.

4. The apparatus of claim 1, further comprising:

a fixture having recesses spaced a predetermined distance from one another, each recess being sufficiently sized to receive the aligned dies; wherein the fixture is configured to support a work-piece spanning across the spaced recesses, thereby allowing the dies to crimp the work-piece at two locations spaced apart by the predetermined distance.

5. The apparatus of claim 4, wherein the fixture includes an adjustment mechanism configured to change the predetermined distance.

6. The apparatus of claim 1, wherein the first groove is characterized by the first cross-sectional shape in the first portion and is further characterized by the second cross-sectional shape in the second portion; and wherein the second groove is characterized by the second cross-sectional shape in the first portion of the second die and is further characterized by the first cross-sectional shape in the second portion of the second die such that the compound cross-sectional shape of the die cavity is rotated in the second portion with respect to the first portion, the first and second dies thereby being configured for imparting a multi-segmented compound cross-sectional shape to a work-piece crimped by the dies.

7. The apparatus of claim 1, wherein the respective segments of each respective groove are offset from one another in a direction of groove depth.

8. The apparatus of claim 1, wherein the respective segments of each respective groove are offset from one another in a direction lateral to a respective centerline of each segment.

* * * * *